United States Patent [19]

Sweeney et al.

[11] Patent Number: 4,496,441

Date of Patent: Jan. 29, 1985

[54] DESULFURIZATION OF COAL

[75] Inventors: Charles T. Sweeney; John K. Bird, both of Waco, Tex.

[73] Assignee: Tetravalent Inc., Waco, Tex.

[21] Appl. No.: 523,843

[22] Filed: Aug. 17, 1983

[51] Int. Cl.[3] ..... C25B 1/34; C25B 9/00

[52] U.S. Cl. ..... 204/98; 204/101; 204/128; 204/129; 204/130; 204/256; 204/255; 423/532; 423/539

[58] Field of Search ..... 204/128, 129, 101, 98, 204/130, 252, 254, 256, 255, 263, 266, 257; 423/532, 539; 209/147, 155

[56] References Cited

U.S. PATENT DOCUMENTS 4,248,681 2/1984 Sweeney ..... 204/103

*Primary Examiner*—R. L. Andrews

*Attorney, Agent, or Firm*—Neal J. Mosely

[57] ABSTRACT

A system for desulfurization of sulfur-containing coal comprises apparatus for comminuting sulfur-containing coal, a gas/solid reactor having an inlet and an outlet, a connection or conduit for supplying the comminuted sulfur-containing coal to the reactor inlet, and an oxidant gas generator constructed in accordance with U.S. Pat. No. 4,248,681 connected to supply an oxidant gas to the reactor. The oxidant gas produced from concentrated salt solutions contains substantial amounts of chlorine dioxide, while the oxidant gas produced from dilute salt solutions contains other oxygen-containing gases. The oxidant gas is introduced at pressures which may range from sub-atmospheric to super-atomospheric and the comminuted coal is mixed or agitated to insure efficient gas/solid contact. The oxidant gas oxidizes the sulfur contaminants of the coal to gaseous sulfur oxides which are removed from the reactor. The desulfurized comminuted coal may be slurried for pipeline transmission.

20 Claims, 15 Drawing Figures

DESULFURIZATION OF COAL

This invention relates to new and useful improvements in desulfurizing sulfur-containing coal by gas phase oxidation.

BRIEF DESCRIPTION OF THE PRIOR ART

Sulfur-containing coal is a major cause of air pollution and is a major factor in the phenomenon which has come to be known as acid rain along the United States-Canadian border region.

There are vast supplies of sulfur-containing coal which are not being used because of the difficulty of eliminating the sulfur oxides from the off gases from the combustion of such coal. As a result, there is a considerable need for an efficient method and apparatus for removal of sulfur from coal prior to combustion.

SUMMARY OF THE INVENTION

One object of this invention is to provide a new and improved method and apparatus or system for the gas phase oxidation and removal of sulfur contaminants from sulfur-containing coal.

Another object is to oxidize sulfur contaminants in coal with an oxidant gas produced by an electrolytic cell having bipolar electrodes between the anode and the cathode, positioned in the anode compartment of the cell.

Another object is to oxidize sulfur contaminants in coal with an oxidant gas comprising chloride dioxide or mixtures thereof with chlorine and/or with ozone and oxygen.

Other objects will be apparent from time to time throughout the specification and claims as hereinafter related.

These objects and other objects of the invention are accomplished by a system for desulfurization of sulfur-containing coal which comprises an apparatus for comminuting sulfur-containing coal, a gas/solid reactor having an inlet and an outlet, a connection or conduit for supplying the comminuted sulfur-containing coal to the reactor inlet, and an oxidant gas generator constructed in accordance with U.S. Pat. No. 4,248,681 connected to supply an oxidant gas to the reactor. The oxidant gas produced from concentrated salt solutions contains substantial amounts of chlorine dioxide, while the oxidant gas produced from dilute salt solutions contains other oxygen-containing gases. The oxidant gas is introduced at pressures which may range from sub-atmospheric to super-atmospheric and the comminuted coal is mixed or agitated to insure efficient gas/solid contact. The oxidant gas oxidizes the sulfur contaminants of the coal to gaseous sulfur oxides which are removed from the reactor. The desulfurized comminuted coal may be slurried for pipeline transmission.

DESCRIPTION OF SOME PREFERRED EMBODIMENTS

Figure 1:
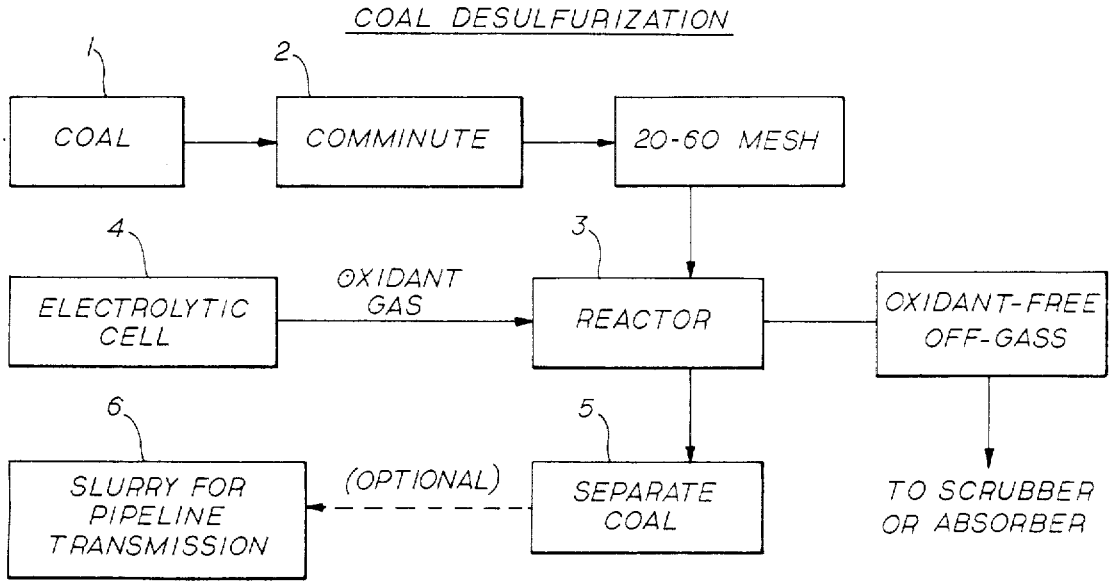
FIG. 1 is a schematic view of a system for desulfurization of sulfur-containing coal in accordance with a preferred embodiment of this invention.

Referring to FIG. 1, there is shown a system for desulfurization of coal. A supply of coal 1 is comminuted as indicated at 2 to a relatively small size, e.g. 20–60 mesh. The comminuted coal is introduced into one side of a gas-solid contacting reactor illustrated schematically at 3. An electrolytic cell 4 produces an oxidant gas mixture which is introduced into reactor 3 where it is intimately mixed with the comminuted coal 2.

In the reactor 3, the oxidant gas from cell 4 oxidizes the sulfur constituents of the coal which are removed as an off-gas containing substantial amounts of sulfur dioxide and trioxide. The off-gas is passed to a scrubber where the sulfur oxides are washed out and recovered as sulfuric acid. The comminuted coal, substantially desulfurized, is separated from the reactor for storage and shipment or immediate use. The fine mesh desulfurized coal may optionally be slurried for transportation by pipeline.

In this gaseous oxidation of the sulfur contaminants of the finely comminuted coal, the particular oxidizing gas produced by the electrolytic cell 4 is unexpectedly efficient. The electrolytic cell 4 is of the type described in Sweeney U.S. Pat. No. 4,248,681 and will be described more fully below. When this cell is run with a high salt concentration, the product gases contain chlorine and a substantial proportion of chlorine dioxide. When the cell is run at low salt concentration, the gases produced comprise oxygen and some ozone. Some hydrogen peroxide is also produced in the liquid phase.

The description of FIGS. 2–15, below, is essentially a repetition of the description found in Sweeney U.S. Pat. No. 4,248,681 but is repeated here to avoid referring to an external document in describing the present invention. This invention comprises a process for the desulfurization of coal by a solid/gas phase oxidation using the oxidant gases produced by the apparatus of Sweeney U.S. Pat. No. 4,248,681 when operated under certain selected conditions. It is therefore deemed appropriate to repeat the description of the Sweeney apparatus and operating procedure to provide a setting for the present invention.

Figure 2:
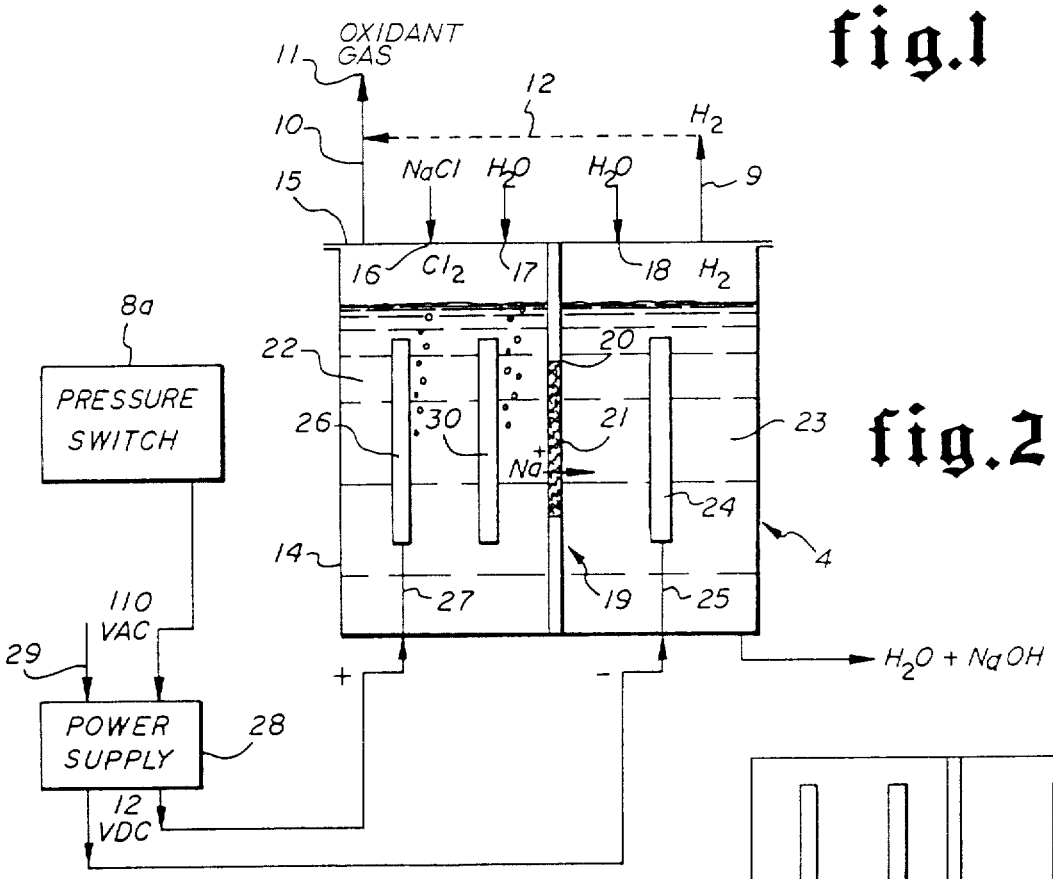
FIG. 2 is a schematic view, in elevation, of a preferred embodiment of the electrolytic generator, of the type shown in U.S. Pat. No. 4,248,681, to be used in the system shown in FIG. 1.

In FIG. 2, electrolytic generator 4 consists of a hollow container 14 having a removable cover 15 sealed in place and having an opening 16 for introduction of a chloride salt (NaCl), and openings 17 and 18 for introduction of water. Hollow container 14 is divided by a vertically extending wall 19 which has a window opening 20 in which there is positioned ion-permeable membrane 21 which conducts cations, e.g. $Na^+$, preferably of the type conventionally used in electrolytic cells provided with membrane separation of the anode and the cathode compartments. The preferred membranes are fluorinated polymers, e.g. perflurosulfonic acid polymers, such as NAFION Registered Trademark, manufactured by Dupont.

Wall member 19 including membrane 21 divides the interior of container 14 into an anode compartment 22 and a cathode compartment 23. A cathode 24 is positioned in cathode compartment 23 and connected by electric lead 25 to a point external to container 14. Anode 26 is positioned in anode compartment 22 and is connected by electric lead 27 to a point external to container 14. The apparatus is provided with a power supply, such as a transformer 28 powered by 110 volt power source 29 and providing a 12 volt D.C. output connected to electric leads 25 and 27. An electrically neutral (bipolar) electrode 30 is positioned in anode compartment 22 in a direct line between anode 26 and cathode 24 and adjacent to ion-permeable membrane 21. Electrode 30 is electrically neutral (bipolar) in the sense that it is not connected by lead wire to the electric circuit energizing the anode 26 and cathode 24 to effect electrolytic decomposition of a salt solution.

Figure 3:
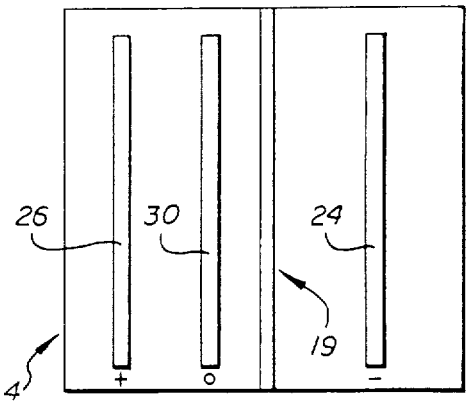
FIG. 3 is a plan view of the electrolytic generator shown in FIG. 2.

In FIG. 3, which is a plan view of the oxidant gas generator 4, the plate-like construction of the various electrodes 24, 26, and 30 is seen. It has been found experimentally that better yields are obtained by increasing the effective area of the anode. Thus, flat-plate electrodes are preferred in the oxidant gas generator of this invention, although in some applications, the cylindrical electrodes or other shape may be used. The cathode 24 is preferably a flat-plate of steel or the like. The anode 26 and the electrically neutral (bipolar) electrode 30 are preferably flat plates of carbon.

OPERATION

The electrolytic generator described and shown in FIGS. 2 and 3 has been tested and found to be substantial improvement over more conventional electrolytic chlorine generators and under certain conditions produce novel oxidant gas compositions.

In the electrolytic generator shown, the cell is charged with water in both the anode compartment 22 and the cathode compartment 23 to a level above the top of the various electrodes but leaving a sufficient space at the top for the collection of gases. Common table salt (NaCl) was added to the water in the anode compartment. In carrying out this process, any soluble chloride salt may be used, e.g. NaCl, KCl, LiCl, RbCl, CsCl, $NH_4Cl$, $MgCl_2$, $CaCl_2$, etc., although for economic reasons sodium chloride is preferred. The ion-permeable membrane 21 in the cell was Dupont NAFION. Neutral (bipolar) electrode 30 was placed approximately one inch from the membrane. 12 volt D.C. were applied and monitored by a D.C. ammeter in the circuit.

The system was turned on. The current flow was 0.250 A; voltage readings of the solution were nearly constant throughout the anode compartment. This indicated that the anode compartment represented a single uniform resistance relative to the cathode. A potential difference between the anode and the neutral (bipolar) electrode was 0.9 V. D.C. There was immediate, visible generation of hydrogen at the cathode. At this current level, there is a substantial lag in the production of gases in the anode compartment. After a short period of time, however, gas begins to form at both the anode 26 and the neutral (bipolar) electrode 30.

The gas produced at the anode 26 and the neutral (bipolar) electrode 30 was unexpectedly found to consist of a mixture of chlorine and chlorine dioxide when a high concentration of salt is used. The proportions of $Cl_2$ and $ClO_2$ varied under different conditions of operation and in some cases the $ClO_2$ is present in a substantial excess over the $Cl_2$. When the current is increased to about 10–11 A. for full production, there is vigorous generation of the gas mixture at the anode 26 and the neutral (bipolar) electrode 30. When operating at full voltage and full current, there is a substantial and measurable potential measured across the three electrodes in the cell. The neutral (bipolar) electrode 30 is at a potential of about 8 V. relative to the cathode. The potential in the brine between the neutral (bipolar) electrode 30 and anode 26 is about 10 V. Anode 26 is at a potential of 12 V. relative to cathode 24.

Under the conditions of operation described above, there is vigorous generation of hydrogen at cathode 24 and a rapid production of sodium hydroxide in cathode compartment 23. Sodium hydroxide is the natural product obtained when the sodium ions passing through ion-permeable membrane 21 are neutralized at cathode 24. The resulting product is sodium metal which is almost instantly converted into sodium hydroxide with evolution of hydrogen. At the same time, there is vigorous generation of the gas mixture in the anode compartment 22 at both the neutral (bipolar) electrode 30 and the anode 26. The evolution of gas commences almost immediately compared to a relatively long induction period for production of chlorine in conventional electrolytic chlorine generators.

In the start up of a chlorine generator, there is usually a substantial induction, or lag time which results from the low conductivity in the cathode compartment. Usually, the operation of the cell is relatively slow until sufficient sodium ions have been converted into sodium hydroxide at the cathode 24 and the caustic solution has reached a sufficient level of concentration to be highly electrically conductive. Likewise, in the anode compartment, there is usually an induction, or lag time resulting from the solubility of chlorine in water, particularly when the chlorine is generated slowly.

In this improved electrolytic generator there is a more rapid build up of sodium hydroxide in the cathode compartment as a result of the short distance that the sodium ions must travel from the neutral (bipolar) electrode 30 to pass through ion-permeable membrane 21. Also, in this generator, the generation of the gas mixture at anode 26 and neutral (bipolar) electrode 30 is so vigorous that there is an almost immediate generation of gas from the cell. The productivity of this cell was initially evaluated using the DPD colorimetric method of measuring residual chlorine in water. Data showed that, at worst cell operating conditions and no temperature problems, production of 1 lb. of chlorine-containing gas per day was easily obtained at a current of 11 A. and only 5 gal. of brine solution. There was no long loss of time for start up and waiting for solutions to be concentrated with salt or caustic levels to rise. In conventional electrolytic chlorine generators the lag time in start up has often been days.

In later experiments, the production of gas in the anode compartment seemed to be greater than theoretical. It was then that $ClO_2$ was discovered as a significant component of the gas produced. The anode compartment gas was collected and bubbled through an absorber for chlorine and the residue analyzed for $ClO_2$ content. The $ClO_2$ was found to be the major constituent of the gas produced in the anode compartment at both the anode 26 and the neutral (bipolar) electrode 30.

In experimental work carried out with this electrolytic generator cell, a number of important observations were made. The resistance of the anode compartment is directly related to the distance of the anode to the cathode and the saturation of salt in the electrolytic solution. The production of the gas mixture at the anode and the neutral (bipolar) electrode and the production of hydrogen at the cathode are directly related to the surface area of these electrodes and the current density. With a greater area of anode surface and neutral (bipolar) electrode surface and a higher current, more gas production occurs. The current flow however is limited by the resistance of the solution in the anode compartment and the rate of flow of sodium ions through ion-permeable membrane 21. The rate of flow of sodium ions through the membrane is also directly related to the caustic level of sodium hydroxide in the solution in cathode compartment 23 and is also related to the area or ion-permeable membrane 21.

By placing neutral (bipolar) electrode 30 in the cell and locating the electrode in line between cathode 24 and anode 26 adjacent to ion-permeable membrane 21, substantial advantages are obtained. Neutral (bipolar) electrode 30 acts as an anode relative to cathode 24 and also acts as a cathode relative to anode 26. In this manner, neutral (bipolar) electrode 30 assists in effecting a rapid transfer of sodium ions to cathode compartment 23 and improves the rate of build up of caustic in that compartment. It also functions to improve the $Cl_2/ClO_2$ output and to reduce the induction period or start up time for the cell.

Tests carried out with this equipment using 6"×12" cathode, 6"×12"×2" anode, 6"×12"×2" neutral (bipolar) electrode and a 2½"×8" ion-permeable membrane has shown that once the cell is saturated with salt a high $Cl_2/ClO_2$ output can be maintained with a small membrane area being used efficiently. The optimum size for the ion-permeable membrane 21 is probably an area not substantially greater than the area required to conduct the maximum current used in the $Cl_2/ClO_2$ generator cell. The cathode 24, anode 26 and neutral (bipolar) electrode 30 are preferably about the same surface area. Some difference in surface area may be used in certain specialized applications as will be described in connection with certain of the alternate embodiments of this invention.

The removal of $Cl_2/ClO_2$ mixture and hydrogen and of caustic solution from the chlorine generator cell 4 is shown schematically, as is the introduction of water and table salt to the generator. Specific construction involves conventional structure in electrolytic cells and in gas recovery from such cells. The collection of hydrogen and of the $Cl_2/ClO_2$ mixture may involve simple gas collection apparatus and may, if desired, involve the use of systems for mixing the hydrogen and $Cl_2/ClO_2$ gas mixture with water for introduction into a body of water as described in connection with FIG. 1 above. Also, the equipment can be used in association with timers or in connection with flow controlling switches or controls or in connection with pressure responsive switches and controls as is well known in the prior art.

When the cell is operated with low salt concentrations, i.e. just sufficient to maintain electrical conductivity, the production of chlorine virtually disappears, and the product gases predominate in oxygen and ozone, with some production of hydrogen peroxide in the liquid phase. When air, or pure oxygen, is circulated through the anode compartment during the electrolysis, the production of ozone is increased. In carrying out the desulfurization of coal according to the present invention, the operation of the cell under conditions which emphasize the production of $ClO_2$ and $O_3$ is preferred.

ALTERNATE EMBODIMENTS OF THE APPARATUS

In FIGS. 4 to 13 there are shown a number of alternate embodiments of the oxidant gas generator shown in FIGS. 2 and 3. In these views, the oxidant gas generator is shown in plan view as in FIG. 3 and is illustrated in a variety of forms using different arrangements of neutral (bipolar) electrodes and/or different configurations of electrodes.

Figure 4:
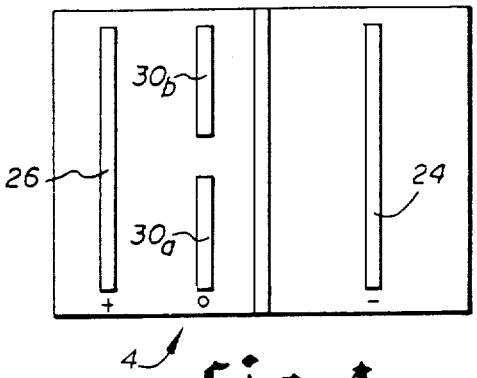
FIG. 4 is a plan view of another embodiment of electrolytic generator, for use in the coal desulfurization system and method, having a plurality of neutral (bipolar) electrodes.

In FIG. 4, the oxidant gas generator 4 has anode 26 and cathode 24 as in FIGS. 2 and 3. Neutral (bipolar) electrode 30, however, is provided as two separate electrodes 30*a* and 30*b*. When the circuit is energized, oxidant gas production occurs at anode 26 and at neutral (bipolar) electrodes 30*a* and 30*b*. When the cell is operated with low salt concentrations, i.e. just sufficient to maintain electrical conductivity, the production of chlorine virtually disappears, and the product gases predominate in oxygen and ozone, with some production of hydrogen peroxide in the liquid phase. When air, or pure oxygen, is circulated through the anode compartment during the electrolysis, the production of ozone is increased.

Figure 5:
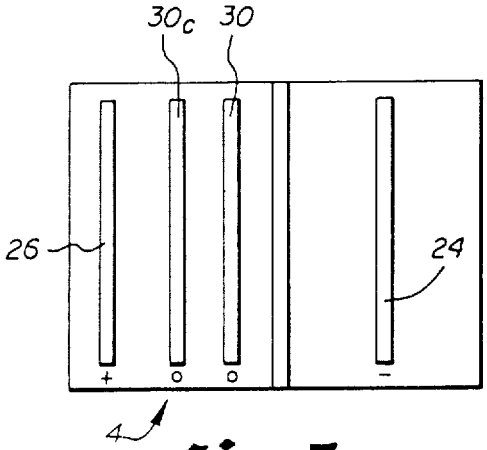
FIG. 5 is a plan view of another embodiment of electrolytic generator, for use in the coal desulfurization system and method, having a plurality of neutral (bipolar) electrodes aligned in series.

In FIG. 5, oxidant gas generator 4 has cathode 24 and anode 26 as in FIGS. 2 and 3. In this embodiment, neutral (bipolar) electrode 30 is positioned adjacent to the ion-permeable membrane and a second neutral (bipolar) electrode 30*c* is positioned between the electrode 30 and anode 26. When the circuit is energized, oxidant gas production occurs at anode 26 and at each of the neutral (bipolar) electrodes 30 and 30*c*. When the cell is operated with low salt concentrations, i.e. just sufficient to maintain electrical conductivity, the production of chlorine virtually disappears, and the product gases predominate in oxygen and ozone, with some production of hydrogen peroxide in the liquid phase. When air, or pure oxygen, is circulated through the anode compartment during the electrolysis, the production of ozone is increased.

Figure 6:
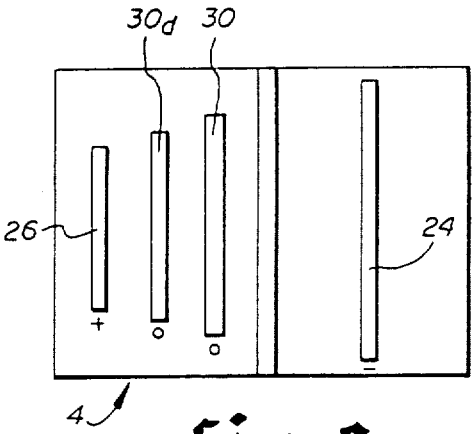
FIG. 6 is a plan view of still another embodiment of electrolytic generator, for use in the coal desulfurization system and method, having a plurality of neutral (bipolar) electrodes and an anode of diminishing size.

In FIG. 6, oxidant gas generator 4 has an anode 26 which is appreciably smaller in area than cathode 24. Neutral (bipolar) electrodes 30 and 30*d* are graduated in size between the large size or cathode 24 and the small size or cathode 26. When the cell is operated with low salt concentrations, i.e. just sufficient to maintain electrical conductivity, the production of chlorine virtually disappears, and the product gases predominate in oxygen and ozone, with some production of hydrogen peroxide in the liquid phase. When air, or pure oxygen, is circulated through the anode compartment during the electrolysis, the production of ozone is increased.

Figure 7:
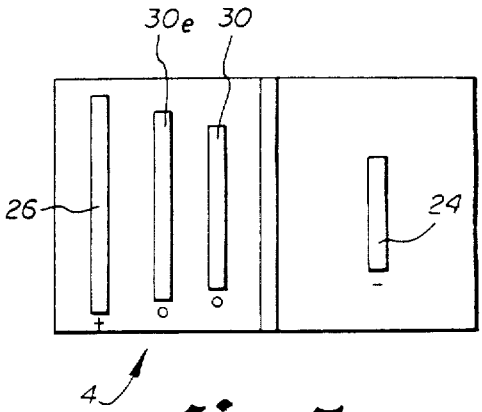
FIG. 7 is a plan view of still another embodiment of electrolytic generator, for use in the coal desulfurization system and method, having a plurality of neutral electrodes and an anode of increasing size.

In FIG. 7, oxidant gas generator 4 has a cathode 24 of relatively small size and anode 26 of substantially larger size. Neutral (bipolar) electrodes 30 and 30*e* are graduated in size. When the cell is operated with low salt concentrations, i.e. just sufficient to maintain electrical conductivity, the production of chlorine virtually disappears, and the product gases predominate in oxygen and ozone, with some production of hydrogen peroxide in the liquid phases. When air, or pure oxygen, is circulated through the anode compartment during the electrolysis, the production of ozone is increased.

Figure 8:
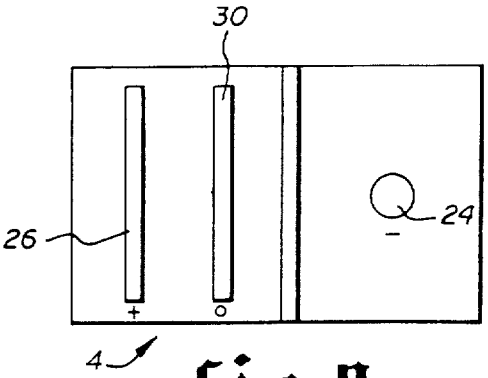
FIG. 8 is a plan view of still another embodiment of electrolytic generator, for use in the coal desulfurization system and method, having a cylindrical cathode and flat plate electrodes and an anode.

In FIG. 8, oxidant gas generator 4 is substantially the same as that shown in FIG. 3, except that cathode 24 is a cylindrical rod.

Figure 9:
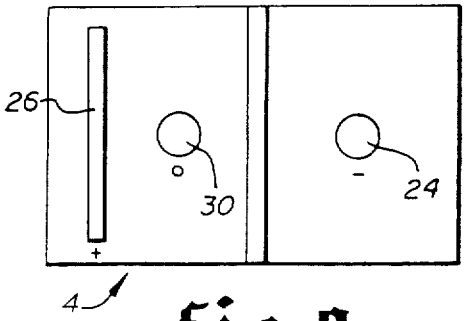
FIG. 9 is a plan view of still another embodiment of electrolytic generator, for use in the coal desulfurization system and method, in which the cathode and the neutral (bipolar) electrode are cylindrical.

In FIG. 9, oxidant gas generator 4 has a cylindrical rod cathode 24 a flat plate anode 26 and cylindrical rod neutral (bipolar) electrode 30.

Figure 10:
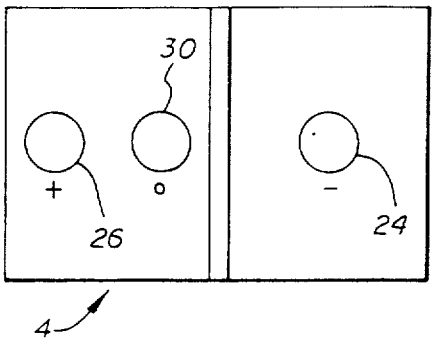
FIG. 10 is a plan view of still another embodiment of electrolytic generator, for use in the coal desulfurization system and method, in which the cathode, anode and neutral (bipolar) electrode are all cylindrical in shape.

In FIG. 10, oxidant gas generator 4 has cathode 24, anode 26 and neutral (bipolar) electrode 30 all in the form of cylindrical rods. In each of these cases, the cylindrical rod cathode is of a metal such as stainless steel and the anode 26 and neutral (bipolar) electrode 30 are preferably of carbon either in the form of a flat-plate or cylindrical rod as shown.

In the several embodiments having multiple neutral (bipolar) electrodes 30, viz. FIG. 4, FIG. 5, FIG. 6, and FIG. 7, the oxidant gas generation takes place at the anode 26 and at each of the separate neutral (bipolar) electrodes. A plurality of neutral (bipolar) electrodes, two or more, may be used as desired. Oxidant gas generation takes place at each of the electrodes and the anode. In the embodiment shown in FIG. 6 the current flow is focused from a large cathode 24 through sequentially smaller neutral (bipolar) electrodes 30 and 30*d* to a smaller anode 26 to provide a higher current density. The reverse effect is obtained in FIG. 7 where the graduated neutral (bipolar) electrodes and 30 and 30*e* focus a high current from a small cathode 26 on to a larger anode 26. The embodiments in FIGS. 8, 9, and 10 illustrate the effect of substitution of cylindrical electrodes in the oxidant gas generator cell.

Figure 11:
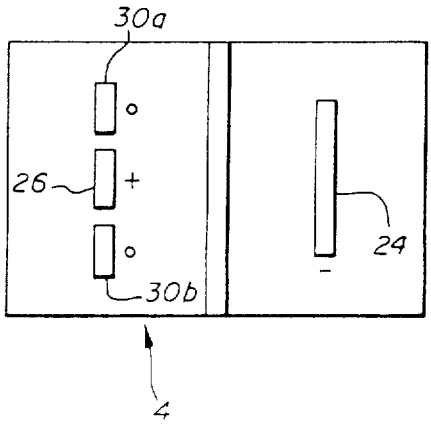
FIG. 11 is a schematic plan view of another embodiment of electrolytic generator, for use in the coal desulfurization system and method, in which the neutral (bipolar) electrodes are positioned adjacent to the anode.

In FIG. 11, there is shown another embodiment of the invention in which the neutral (bipolar) electrodes 30*a* and 30*b* are located adjacent to anode 26 and aligned therewith. In this embodiment, the neutral (bipolar) electrodes are spaced at the same distance from the cathode 24 as anode 26 rather than being in line between the anode and cathode. The neutral (bipolar) electrodes are preferably spaced closely to each side of anode 26 but not in physical contact therewith. When this embodiment is filled with saturated aqueous chloride salt, as in the other embodiments, and energized, the gas evolved at anode 26 contains 1.5 parts chlorine dioxide per part chlorine.

Figure 12:
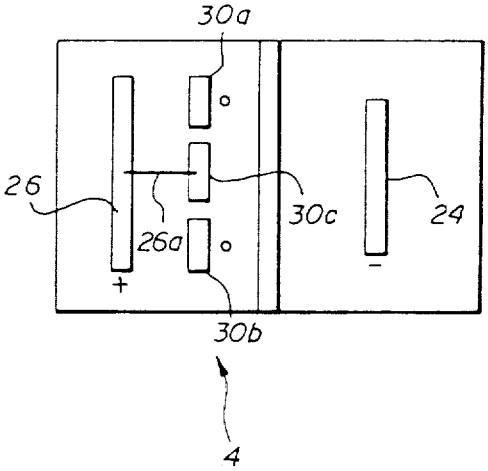
FIG. 12 is a schematic plan view of another embodiment of electrolytic generator, for use in the coal desulfurization system and method, in which a plurality of neutral (bipolar) electrodes are positioned side-by-side between the anode and cathode.

In FIG. 12, there is shown still another embodiment of the invention in which a plurality of electrodes 30*a*, 30*b* and 30*c* are positioned side-by-side between anode 26 and cathode 24. Electrodes 30*a*, 30*b* and 30*c* are also considered to be positioned in parallel in an electrical sense since they represent parallel paths for current flow between anode 26 and cathode 24. The central electrode 30*c* is connected by lead 26*a* to anode 26 and is thus maintained at the same potential as anode 26, less any voltage drop through the lead, relative to cathode 24. When this embodiment is energized, the output from electrode 30*c* is pure chlorine dioxide while the output from anode 26 is a mixture of chlorine and chlorine dioxide.

Figure 13:
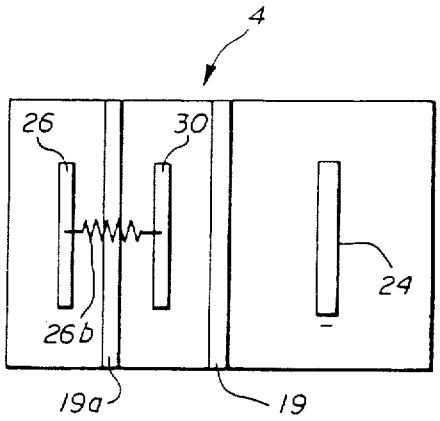
FIG. 13 is a schematic plan view of another embodiment of electrolytic generator, for use in the coal desulfurization system and method, in which the neutral (bipolar) element is separated from the anode and cathode compartments by ion-permeable membranes.

In FIG. 13, there is shown an embodiment of the invention in which electrode 30 is isolated from both the cathode 24 and anode 26 by separators 19 and 19*a*, respectively. Anode 26 is connected by a resistor 26*a* to electrode 30 to maintain the same at a lower potential than the anode relative to cathode 24. When this embodiment is energized, the output from electrode 30 is pure chlorine while the output from anode 26 is a mixture of a major amount of chlorine dioxide and a minor amount of chlorine.

Figure 14:
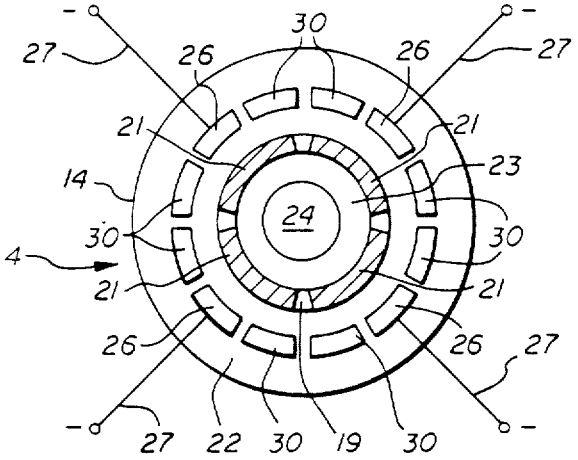
FIG. 14 is a schematic view of a cylindrical electrolytic generator for use in the coal desulfurization system and method.

In FIG. 14, there is shown a further embodiment in which electrolytic generator 4 is housed in a cylindrical container 14. Separator wall 19 is cylindrical and divides the generator into anode compartment 22 and cathode compartment 23. Separator wall 19 includes a plurality of ion-permeable membranes 21. Cathode 24 is positioned in compartment 23 and is connected to the D.C. power source. A plurality of anodes 26 are spaced around anode compartment 22. A plurality of neutral (bipolar) electrodes 30 are positioned between anodes 26. Anodes 26 are connected to a common lead or connection to the power source. When energized, this generator produces hydrogen from compartment 23 and chlorine dioxide and a small amount of chlorine from compartment 22.

Figure 15:
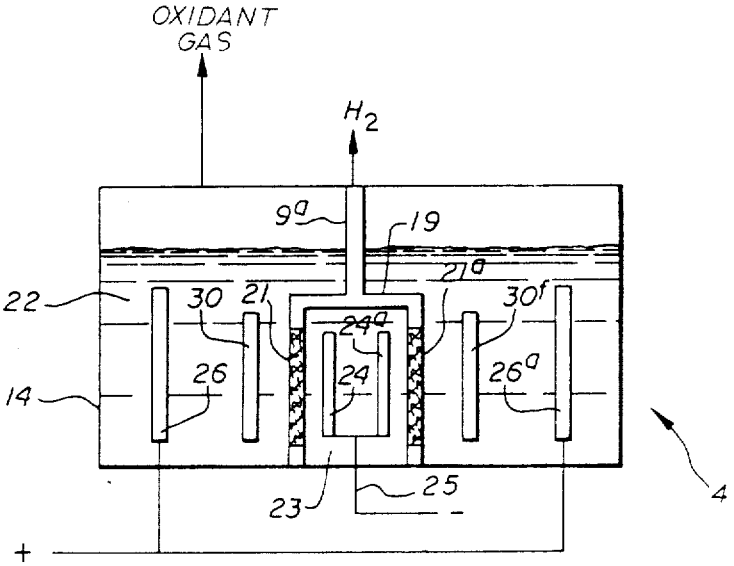
FIG. 15 is a schematic view, in elevation, of still another embodiment of electrolytic generator, for use in the coal desulfurization system and method, having a pair of cathodes and a pair of anodes.

In FIG. 15, there is shown still a further embodiment of the invention in the form of a double cell. Chlorine/-chlorine dioxide generator 4 consists of hollow container 14 having wall 19 completely enclosing the cathode chamber 23. A pair of ion-permeable membranes 21 and 21*a* are positioned on opposite sides of wall 19. A pair of cathodes 24 and 24*a* are provided in cathode compartment 23 and are connected to the electric circuit by lead 25. A conduit 9*a* leads from the end wall portion of wall 19 to conduct hydrogen from cathode compartment 23.

Anode compartment 22 completely surrounds wall 19 and the liquid level completely covers cathode chamber 23. A pair of anodes 26 and 26*a* are provided.

A pair of neutral (bipolar) electrodes 30 and 30*f* are provided and positioned in direct line between the respective cathodes and anodes and adjacent to the ion-permeable membrane. Chlorine is produced from each of the anodes 26 and 26*a* and the neutral (bipolar) electrodes 30 and 30*f* and hydrogen and caustic are produced in cathode chamber cell is the same as the other embodiments, except that the number of electrodes is doubled.

The output of oxidant gas and hydrogen from the cell in FIG. 14 or in any of the other embodiments may be supplied as the oxidizing gas directly to the reactor 3 in the system of FIG. 1. While the mixture of $Cl_2$ and $ClO_2$ produced when a saturated salt solution is electrolyzed may be used in the desulfurizing of coal, better results are obtained with the $O_2$, $O_3$, and $ClO_2$ mixture produced at low salt concentrations.

The use of the apparatus described above and illustrated in the various figures of the drawings is a recently developed method for the preparation of chlorine dioxide and mixtures of chlorine dioxide and chlorine and other oxidants. A variety of experiments were carried out in the development of this apparatus to evaluate some of the parameters of the use of the apparatus.

OPERATION OF THE IMPROVED ELECTROLYTIC CELL

The apparatus described above is used in a novel process for the production of of chlorine dioxide and mixtures of chlorine dioxide and chlorine and other oxidants. It was found in the testing of this apparatus that the electrolysis of saturated chloride salt solutions in an electrolytic cell divided into two compartments by a separator or membrane may produce chlorine dioxide or mixtures of chlorine dioxide and chlorine. In such an apparatus, one compartment contains the cathode and other compartment contains a plurality of electrodes some of which have electrical connections as anodes and some of which are electrically unconnected and are thus neutral (bipolar) electrodes. In such an apparatus, the electrolysis of a chloride salt solution produces hydrogen at the cathode and a mixture of chlorine and chlorine dioxide at the anode or anodes and the neutral (bipolar) electrodes. In some arrangements of the apparatus, it is possible to isolate the production of chlorine dioxide and obtain a yield of substantially pure chlorine dioxide. Some of the variables that enter into the production of chlorine dioxide in the process are evaluated in the following experimental examples. At low salt concentrations, the cell produced a mixture of oxidant gases including $ClO_2$, $O_2$, and $O_3$.

EXAMPLE I

In this experimental run, the electrolysis unit was essentially as described in FIG. 2 of the drawings but using two neutral (bipolar) electrodes as illustrated in FIG. 4. The apparatus consisted of a ten gallon container 14 divided by separator 19 which was 0.8 cm. thick and contained an ion exchange membrane 21 having a surface area of 102.6 cm.$^2$ In normal operation, anode compartment 22 is charged with water and an excess of chloride salt, e.g. sodium chloride, and cathode compartment is filled with water. As the electrolysis is carried out, the cathode compartment produces an aqueous solution of sodium hydroxide which becomes more and more concentrated as the reaction goes on. In the experiments that were carried out with this apparatus, anode compartment 22 was filled with a saturated sodium chloride solution and cathode compartment 23 was filled to an equal level with a solution of 30 g/l. sodium hydroxide with water. This arrangement approximates the condition of the system after it has been operated for some time.

In the equipment used in this example, anode 26 was a carbon plate and was mounted 5.0 cm. from divider 19. The neutral (bipolar) electrodes 30*a* and 30*b* consisted of two carbon electrodes 2.54 cm.×1.27 cm.×20.32 cm., parallel to anode 26, and spaced 3.18 cm. apart, were mounted between anode 26 and divider 19. In this example, the neutral (bipolar) electrodes were positioned 4 cm. from the anode and 2.8 cm. from the cathode and were adjacent to ion exchange membrane 21.

A partial partition was mounted at the top of the unit in such a manner that the partition extended below the surface of the liquid in the anode compartment 22 so that the gases evolved at anode 26 and neutral (bipolar) electrodes 30 and 30*b* could be separately removed, without interfering with the flow of current or the circulation of ions between the various electrodes. Vapor discharge lines were provided near the top of the sides of the anode compartment to permit the escape of gases from the vapor phase in the area above the surface of the liquid in the anode compartment. A similar vapor discharge arrangement was provided near the top of the sides of the compartment in the cathode compartment to permit recovery of hydrogen.

A slight negative pressure was maintained on the anode compartment by use of an aspirator connected to a water supply and connected to the vapor discharge lines. The gases produced at the anode and the neutral (bipolar) electrode were separately removed as produced and were passed through a scrubber system to separate the chlorine and chlorine dioxide. A sodium hydroxide scrubber was placed on the suction of the separators to absorb chlorine and chlorine dioxide produced between runs.

The arrangement for separating chlorine from chlorine dioxide consisted of a separator which was a 100 ml. Nessler tube containing 90 ml. of a 10 g/liter solution of glycine in water followed by a 100 ml. Nessler tube containing 90 ml. of a 50 g/liter solution of potassium iodide which was acidified to pH 1.5 with sulfuric acid.

The glycine reacted with the chlorine to produce the monochloro and dichloro addition product with glycine. The unreacted chlorine dioxide was absorbed in the glycine solution or passed into the second tube where it reacted with the acidified potassium iodide to release iodine.

The glycine solution was analyzed for chlorine and chlorine dioxide by the D.P.D. method 409 E, Standard Methods for Examination of Water and Waste Water, 14th Edition, American Public Health Association. The potassium iodide solution was analyzed for chlorine dioxide by the Iodometric Method, 411 A, Standard Method for Examination of Water and Waste Water.

This analytical technique for separation of chlorine dioxide and chlorine is accepted as accurate when both gases are in the vapor phase as was the case in this study. Analytical results on the efficiency of the separation technique were in general agreement with those reported by Aiteta, et al., Stamford University, EPA Symposium, Cincinnati, Ohio, Sept. 18–20, 1978, and were considered acceptable.

In this example, the electrolysis was carried out at 12 V. and 20 A. The gases obtained from the neutral (bipolar) electrode 30*a* and 30*b* were a mixture of 1.02 parts by weight chlorine dioxide and one part chlorine. The gases obtained from the anode 26 were a mixture of 2.22 parts chlorine dioxide and one part chlorine. The combined gases from anode chamber 22 contained 1.7 parts by weight chlorine dioxide per part chlorine.

A number of additional experiments were carried out using the same apparatus with some variations in location of electrodes, in current density, and in concentration of salt solution to determine the effect of varying these conditions of the electrolytic process.

EXAMPLES II AND III

In Example II, the apparatus and conditions of Example I were repeated except that the distance between anode 26 and neutral (bipolar) electrodes 30*a* and 30*b* was decreased from 4 cm. to 3 cm. In this experiment, there was a production of 1.09 parts chlorine dioxide per part of chlorine at the neutral (bipolar) electrodes 30*a* and 30*b* and a production of 4.50 parts chlorine dioxide per part chlorine at the anode 26. In the combined gases evolved from anode compartment 22 there were obtained 3.30 parts chlorine dioxide per part chlorine.

In Example III, the conditions of Example II were repeated but the distance between anode 26 and neutral (bipolar) electrodes 30*a* and 30*b* was decreased from 3 cm. to 2 cm. In this experiment, the gases evolved at neutral (bipolar) electrodes 30*a* and 30*b* contained 2.19 parts chlorine dioxide per part chlorine. The gases evolved at anode 26 contained 4.70 parts chlorine dioxide per part chlorine. In the combined gases from anode compartment 22 there were 4.08 parts chlorine dioxide per part chlorine.

EXAMPLE IV

In this experiment, the conditions of Example I were reproduced except that neutral (bipolar) electrodes 30*a* and 30*b* were removed from the system. Anode 26 was spaced 6.8 cm. from cathode 24 as in Example I. They system was operated at 12 V. and 15 A. using a saturated salt (NaCl) solution in anode compartment 22. Under these conditions, the yield from anode 26 was pure chlorine. There was no chlorine dioxide produced in the absence of neutral (bipolar) electrodes 30*a* and 30*b*.

EXAMPLE V

Effect of Current Density

A series of runs were made at 12 V. and 20 A., 10 V., and 5 A., respectively. The distance between anode 26 and neutral (bipolar) electrodes 30*a* and 30*b* were also varied as in Examples I, II, and III.

The data obtained were erratic and do not correlate well at lower currents. In each case, the total volume of gas evolved was proportional to the current used. Also, the gased evolved in anode compartment 22 were a mixture of chlorine dioxide and chlorine with chlorine dioxide predominating.

EXAMPLE VI

Effect of Salinity

A series of experiments were carried out to evaluate the effect of salt concentration on the production of chlorine dioxide. These experiments used a salt solution of 175 g/l which is one-half saturated. In each of the experiments, which involved a variation in spacing of the neutral (bipolar) electrodes and a variation in current density, there was a substantial reduction in the amount of chlorine dioxide and chlorine produced and the proportion of chlorine dioxide was significantly lower although the chlorine dioxide usually predominated.

Further experiments were carried out in which the salt concentration was reduced to the point where it was just enough to carry the electric current. At this level the chloride content is so low that virtually no chlorine or chlorine dioxide is produced. At this level the oxidant gases produced contain $O_2$ and $O_3$, and some $H_2O_2$ is produced in the liquid phase. At slightly higher salt concentrations, small amounts of $Cl_2$ and $ClO_2$ are produced as well as $O_2$ and $O_3$.

EXAMPLE VII

An experiment was carried out using the apparatus illustrated in FIG. 13 of the drawings. The electolytic generator was operated using a saturated salt solution and 20 amp. The voltage drop through resistor 26*b* was 0.04 V. The electrode 30 had a potential of 8.07 V. relative to the cathode. Anode 26 had a potential of 8.11 V. relative to cathode 24. In this run, no chlorine dioxide was produced at electrode 30 although a substantial amount of chlorine was produced. At anode 26 there was a substantial production of a mixture of chlorine dioxide and chlorine with chlorine dioxide predominating.

EXAMPLE VIII

In this run, an electrolytic generator was used as described in FIG. 12. The generator was operated using a saturated salt solution at 16 amp. current. Anode 26 and electrode 30*c* were maintained at a potential of 9.1 V. relative to cathode 24. Neutral (bipolar) electrodes 30*a* and 30*b* were at a potential of 5.84 V. relative to cathode 24 and a potential of 3.23 V. relative to anode 26 and electrode 30*c*.

Under these conditions, there was a substantial productin of approximately equal amounts of chlorine and chlorine dioxide as a mixture at anode 26. There was also a substantial production of gas from electrode 30*c* and no gas evolved at electrodes 30*a* and 30*b*. The gas evolved at electrode 30*c* was pure chlorine dioxide with no chlorine or other gases present.

EXAMPLE IX

In this experiment, the apparatus in FIG. 12 was used but was modified so that electric leads were connected to electrodes 30*a* and 30*b* instead of to electrode 30*c*. The cathode-anode potential was 9.06 V. The potential of the electrically connected electrodes 30*a* and 30*b* relative to cathode 24 was also 9.06 V. The potential of the electrically neutral (bipolar) electrode 30*c* was 3.25 V. relative to anode 26 and 5.77 V. relative to cathode 24.

In this run, the production of gas at anode 26 was exclusively chlorine. The production of gas at electrodes 30*a* and 30*b* was about 30% chlorine dioxide and 70% chlorine.

EXAMPLE X

In this run, the apparatus of FIG. 12 was used but all three of the electrodes 30*a*, 30*b* and 30*c* were connected by electric leads to anode 26. The generator was operated at a potential of 8.91 V. for the anode 26 and electrodes 30*a*, 30*b* and 30*c* relative to cathode 24 and a current of 17 amp. In this run, the production of gas at cathode 26 and at the electrically connected electrodes 30*a*, 30*b* and 30*c* was entirely chlorine with no chlorine dioxide formed.

From these and other experiments, it has been possible to make some observations with respect to this new and improved electrolytic process for the production of chlorine dioxide and/or mixtures of chlorine dioxide and chlorine. It is believed that the use of this cell, as described, represents the first known process for the production of chlorine dioxide by electrolysis of chlorine salt. This novel electrolytic process involves the use of an electrolytic cell having two compartments separated by a permeable membrane with the cathode being located in one compartment and the anode in another compartment.

The anode compartment contains a plurality of electrodes at least one of which is electrically connected as an anode and one or more of which are electrically unconnected and are called neutral (bipolar) electrodes. The neutral (bipolar) electrodes are not strictly neutral (bipolar) since they have a potential relative to the cathode when the system is energized. This potential results from the flow of electric current through the electrolyte from the anode to the neutral (bipolar) electrodes and thence through the electrolyte to the cathode.

The neutral (bipolar) electrodes may be located between the anode and the cathode or may be located to either side of the anode for the best results. If the neutral (bipolar) electrodes are located beyond the anode there is a very substantial loss of efficiency although it is possible in some circumstances to produce some chlorine dioxide. It should be noted that the electrolytic cell may have the compartments vertically disposed, if desired. In such an arrangement wall 19 and membrane 21 extend horizontally and the anode and cathode compartments are located one above the other.

DESULFURIZATION OF COAL

EXAMPLE XI

A high sulfur coal (nut grade West Virginia coal, 3.23% sulfur content, 13,500 B.T.U.) was comminuted to 60 mesh size particles and placed in an enclosed reactor. Oxidant gas, comprising a mixture of $O_2$, $O_3$, $ClO_2$, and $Cl_2$, produced by the cell described in FIG. 2, was introduced into the reactor at a pressure of 0.5 p.s.i.g. The coal and gas were agitated together for a period of 15 min. The gas discharged from the reactor was completely free of oxidant. The gas discharged was passed into a water absorber which absorbed the sulfur oxides as $H_2SO_3$ and $H_2SO_4$. The coal was analyzed for sulfur content and it was found that 44.1% of the sulfur had been removed by oxidation. The amount of oxidant consumed in this reaction was 2.94 g. oxidant per gram of sulfur removed.

EXAMPLE XII

A high sulfur coal (same type as used in Example XI) was comminuted to 20–60 mesh size particles (particles pass a 20 mesh screen but are retained by a 60 mesh screen) and placed in an enclosed reactor. Oxidant gas, comprising a mixture of $O_2$, $O_3$, $ClO_2$, and $Cl_2$, produced by the cell described in FIG. 2, was introduced into the reactor at atmospheric pressure. The coal and gas were agitated together for a period of 30 min. The gas discharged from the reactor contained 1,928 mg.oxidant per liter of gaseous effluent. The gas discharged was passed into a water absorber which absorbed the sulfur oxides as $H_2SO_3$ and $H_2SO_4$. The coal was analyzed for sulfur content and it was found that 31.5% of the sulfur had been removed by oxidation. The amount of oxidant consumed in this reaction was 8.1 g. oxidant per gram of sulfur removed.

EXAMPLE XIII

A high sulfur coal (same type used in Examples XI and XII) was comminuted to 60 mesh size particles and placed in an enclosed reactor with inlet and outlet connections for controlled circulation of oxidant gas therethrough. Oxidant gas, comprising a mixture of $O_2$, $O_3$, $ClO_2$, and $Cl_2$, produced by the cell described in FIG. 2, was introduced into the reactor at a pressure of 14.2 p.s.i.a. and circulated through the reactor at a rate giving a residence time of 0.5 min. The coal was agitated while circulating the oxidant gas therethrough for a period of 30 min. The gas discharged from the reactor had an oxidant content of 85 mg. oxidant per liter and the sulfur oxides produced by the reaction with the coal. The gas discharged was passed into a water absorber which absorbed the sulfur oxides as $H_2SO_3$ and $H_2SO_4$. The coal was analyzed for sulfur content and it was found that 25% of the sulfur had been removed by oxidation. The amount of oxidant consumed in this reaction was 3.5 g. oxidant per gram of sulfur removed.

This process can be carried out using the oxidant gas from any of the electrolytic cells shown in FIGS. 2–15, but is preferably the effluent from a cell operated at low salt concentration which has a substantial content $O_2$ and $O_3$. The coal must be comminuted to a particle size small enough to get a good gas-solid reaction and preferably a particle size suitable for slurrying for pipeline transportation. The oxidant gas may be reacted with the coal particles in a batch or a continuous reaction, with agitation of the coal. The oxidant gas is preferably contacted with the coal particles under a pressure of 100 to 850 mm. Hg. Higher pressures can be used in the process but expensive modifications in the system are required. In carrying out this desulfurization process, a particularly effective technique is to carry out the reaction by passing the pressurized oxidant gas mixture countercurrently through a quantity of the particulate coal which is being advanced through the reactor by a screw feeder. This ensures complete consumption of the oxidant gas and maximizes oxidation of the sulfur components of the coal to $SO_2$ and $SO_3$.

We claim:

1. A method for coal desulfurization which comprises providing an oxidant gas generator comprising a hollow container having a wall dividing the same into two compartments and including an ion-permeable membrane permitting flow of cations therethrough, a cathode in one of said compartments, an anode in the other of said compartments, a bipolar electrode in said other compartment positioned between said anode and said membrane, said bipolar electrode being of a size and shape permitting free circulation of electrolyte therearound and being exposed on all sides to the same aqueous electrolyte, providing water to said cathode compartment, providing a water solution of a chloride salt to said anode compartment to surround said anode and said bipolar electrode, passing a predetermined amount of direct current through said water and said a chloride salt solution to produce an oxidant gas at said anode and said bipolar electrode and to produce hydrogen and solium hydroxide at said cathode, collecting said oxidant gas, providing a quantity of sulfur-containing coal, comminuting said sulfur-containing coal, providing a gas/solid reactor, supplying said comminuted sulfur-containing coal to said reactor, and introducing said oxidant gas into said reactor and reacting the same with said sulfur-containing coal to oxidize and remove the sulfur components therein.

2. A method according to claim 1 in which said solution is a concentrated solution and said oxidant gas contains chlorine dioxide.

3. A method according to claim 1 in which said solution is a dilute solution and said oxidant gas comprises oxygen-containing compounds.

4. A method according to claim 1 in which said oxidant gas is circulated through said reactor in intimate contact with said comminuted sulfur-containing coal and substantially oxidant-free gas is discharged from said reactor.

5. A method according to claim 4 in which said sulfur-containing coal is mixed while passing oxidant gas therethrough.

6. A method according to claim 4 in which said oxidant gas is contacted with said sulfur-containing coal in an amount sufficient to oxidize the sulfur-containing constituents thereof.

7. A method according to claim 4 in which said oxidant gas is at a pressure not greater than atmospheric pressure.

8. A method according to claim 4 in which said oxidant gas is at a superatmospheric pressure.

9. A system for desulfurization of sulfur-containing coal comprising means for comminuting sulfur-containing coal, a gas/solid reactor having an inlet and an outlet, means for supplying comminuted sulfur-containing coal from said comminuting means to said reactor inlet, an oxidant gas generator comprising a hollow container having a wall dividing the same into a first and a second compartment said wall including an ion-permeable membrane permitting flow of cations therethrough, an anode positioned in said first compartment, a cathode positioned in said second compartment, a bipolar electrode positioned in said first compartment, in line between said anode and said cathode and adjacent to said ion-permeable membrane, said bipolar electrode being of a size and shape permitting free circulation of electrolyte therearound and being exposed on all sides to the same aqueous electrolyte, said generator being adapted to be substantially filled with water in both of said compartments and to have a chloride salt added to said first compartment and to have said anode and said cathode connected in a direct current electric circuit, said anode and said cathode being operable when so filled and energized to produce hydrogen at said cathode and an oxidant gas comprising a mixture of chlorine and chlorine dioxide at said anode and at said bipolar electrode when substantially saturated with chloride salt, and an oxidant gas predominating in oxygen-containing components when having a low salt concentration, means forming outlets from said first and said second compartment for conducting oxidant gas and hydrogen, respectively, therefrom, and means conducting said oxidant gas to said reactor inlet for reaction with said comminuted sulfur-containing coal.

10. A coal desulfurization system according to claim 9 including means to discharge spent, substantially oxidant-free gas from said reactor.

11. A coal desulfurization system according to claim 9 including means for slurrying coal for pipeline transportation, and means connecting the outlet of said reactor to said slurrying means for discharging comminuted coal thereto after reaction with said oxidant gas.

12. A coal desulfurization system according to claim 9 in which at least one of said electrodes of said oxidant gas generator has a surface area different from other electrodes.

13. A coal desulfurization system according to claim 9 in which there are a plurality of said bipolar electrodes in said oxidant gas generator positioned between said anode and said ion-permeable membrane.

14. A coal desulfurization system according to claim 9 in which said ion-permeable membrane comprises only part of said wall of said oxidant gas generator.

15. A coal desulfurization system according to claim 9 in which said wall surrounds said second compartment and said first compartment surrounds said wall in said oxidant gas generator.

16. A coal desulfurization system according to claim 9 in which said oxidant gas generator container includes openings for introduction of water and a chloride salt and openings for removal of sodium hydroxide and of hydrogen and oxidant gases.

17. A coal desulfurization system according to claim 9 in which said oxidant gas generator ion-permeable membrane comprises a perflurosulfonic polymer.

18. A system for desulfurization of sulfur-containing coal comprising means for comminuting sulfur-containing coal, a gas/solid reactor having an inlet and an outlet, means for supplying comminuted sulfur-containing coal from said comminuting means to said reactor inlet, an oxidant gas generator comprising a hollow container having a wall dividing the same into a first and a second compartment said wall including an ion-permeable membrane permitting flow of cations therethrough, an anode positioned in said first compartment, a cathode positioned in said second compartment, a bipolar electrode positioned in said first compartment, in line between said anode and said cathode and adjacent to said ion-permeable membrane, said bipolar electrode being of a size and shape permitting free circulation of electrolyte therearound and being exposed on all sides to the same aqueous electrolyte, said generator being adapted to be substantially filled with water in both of said compartments and to have a chloride salt added to said first compartment and to have said anode and said cathode connected in a direct current electric circuit, said anode and said cathode being operable when so filled and energized to produce hydrogen at said cathode and an oxidant gas comprising a mixture of chlorine and chlorine dioxide at said anode and at said bipolar electrode when substantially saturated with chloride salt, and an oxidant gas predominating in oxygen-containing components when having a low salt concentration, means forming outlets from said first and said second compartment for conducting oxidant gas and hydrogen, respectively, therefrom, means conducting said oxidant gas to said reactor inlet for reaction with said comminuted sulfur-containing coal, means to discharge spent, substantially oxidant-free gas from said reactor, means for slurrying coal for pipeline transportation, and means connecting the outlet of said reactor to said slurrying means for discharging comminuted coal thereto after reaction with said oxidant gas.

19. A coal desulfurization system according to claim 18 in which said ion-permeable membrane comprises only part of said wall of said oxidant gas generator.

20. A coal desulfurization system according to claim 18 in which said oxidant gas generator ion-permeable membrane comprises a perflurosulfonic polymer.

* * * * *